US005277293A

United States Patent [19]

Nakanishi

[11] Patent Number: 5,277,293

[45] Date of Patent: Jan. 11, 1994

[54] PACKAGE TRANSFER EQUIPMENT

[75] Inventor: Kazuo Nakanishi, Uji, Japan

[73] Assignee: Murata Kikai Kabushiki Kaisha, Kyoto, Japan

[21] Appl. No.: 936,566

[22] Filed: Aug. 27, 1992

[30] Foreign Application Priority Data

Aug. 30, 1991 [JP] Japan ..... 3-69541[U]

[51] Int. Cl.[5] ..... B65G 47/46

[52] U.S. Cl. ..... 198/367; 198/468.8; 198/409

[58] Field of Search ..... 198/409, 468.8, 367, 198/370, 367.1

[56] References Cited

U.S. PATENT DOCUMENTS

| | | | |
|---|---|---|---|
| 1,057,556 | 4/1913 | Joor | 198/367 X |
| 1,881,899 | 10/1932 | Olson | 198/367 X |
| 2,535,866 | 12/1950 | Rasmussen | 198/367 X |
| 2,924,325 | 2/1960 | Kay et al. | 198/367 |
| 3,534,876 | 10/1970 | Bornstein et al. | 198/468.8 X |
| 3,557,940 | 1/1971 | Rogers et al. | 198/367 X |
| 4,763,773 | 8/1988 | Kawarabashi et al. | 198/409 |
| 5,007,522 | 4/1991 | Focke et al. | 198/468.8 |
| 5,113,995 | 5/1992 | Sakurai | 198/409 |
| 5,118,240 | 6/1992 | Kyoo | 198/468.8 X |
| 5,141,095 | 8/1992 | Kamp | 198/409 |

*Primary Examiner*—D. Glenn Dayoan

*Attorney, Agent, or Firm*—Spensley Horn Jubas & Lubitz

[57] ABSTRACT

A package transfer system having a package elevator located between an overhead conveyor and stock conveyors. Withdrawable delivery members are installed on the runway of the package elevator. When in an up position, the delivery members function to deliver packages from the descending elevator to the stock conveyor. When in a down position, the delivery members allow the downward passage of the packages on the elevator.

5 Claims, 6 Drawing Sheets

PACKAGE TRANSFER EQUIPMENT

BACKGROUND OF THE INVENTION

1. Field of the Invention

The present invention relates to a package transfer equipment for receiving packages from an overhead conveyor and delivering them to a stock conveyor located below the overhead conveyor.

2. Prior Art

Packages produced by a winder are suspended and transported by an overhead conveyor, being stocked on a multiple-stage stock conveyors located below the overhead conveyor. That is, for transportation, there is required such a device that receives packages from the overhead conveyor and transfers them over onto the stock conveyor. As this type of package transfer equipment, "a package transfer equipment" disclosed in Laid-Open Japanese Patent No. Hei 1-96472 has already been developed by the present applicant.

The package transfer equipment mentioned above, however, has the disadvantages that since packages suspended from the overhead conveyor are transferred by a package receiving-delivering means onto a package receiving table, which is then lowered to carry the packages downwardly, and are delivered to a stock conveyor by a two-step motion, the whole equipment will become costly, and that package transfer motion can not quickly be performed.

OBJECT AND SUMMARY OF THE INVENTION

In view of the above-described disadvantages inherent in the heretofore known equipment, it is an object of the present invention to provide a package transfer equipment which is of a simple constitution and is capable of operating at a high speed.

To accomplish the above-mentioned object, the package transfer equipment of the present invention comprises a package elevator located between an overhead conveyor and stock conveyors, and a package delivery member which is withdrawably mounted on the runway of the package elevator adjacent to each of the stock conveyors and protrudes when delivering the package from the descending elevator to the stock conveyor side and is withdrawn to allow the downward passage of the package on the elevator.

According to the package transfer equipment of the aforementioned constitution, packages suspended from the overhead conveyor are transported by the package elevator to the stock conveyor side located below. At this time, when the delivery member provided on the runway of the package elevator is the up position, the packages on the descending elevator are caught by this delivery member, being delivered to the stock conveyor side. Also when the delivery member are withdrawn, the packages on the elevator are allowed to pass downwardly. This delivery member is provided by each stock conveyor and therefore it is possible to stock the packages on a desired stock conveyor by raising a specific delivery member.

According to the present invention, since the delivery members withdrawably provided on the runway of the package elevator on which the packages descend are of extremely simple constitution and accordingly inexpensive, it is possible to accomplish the transfer of packages at a high speed and at a low cost.

DETAILED DESCRIPTION OF PREFERRED EMBODIMENT

Hereinafter one example of the package transfer equipment according to the present invention will be explained with reference to the accompanying drawings.

Figure 1:
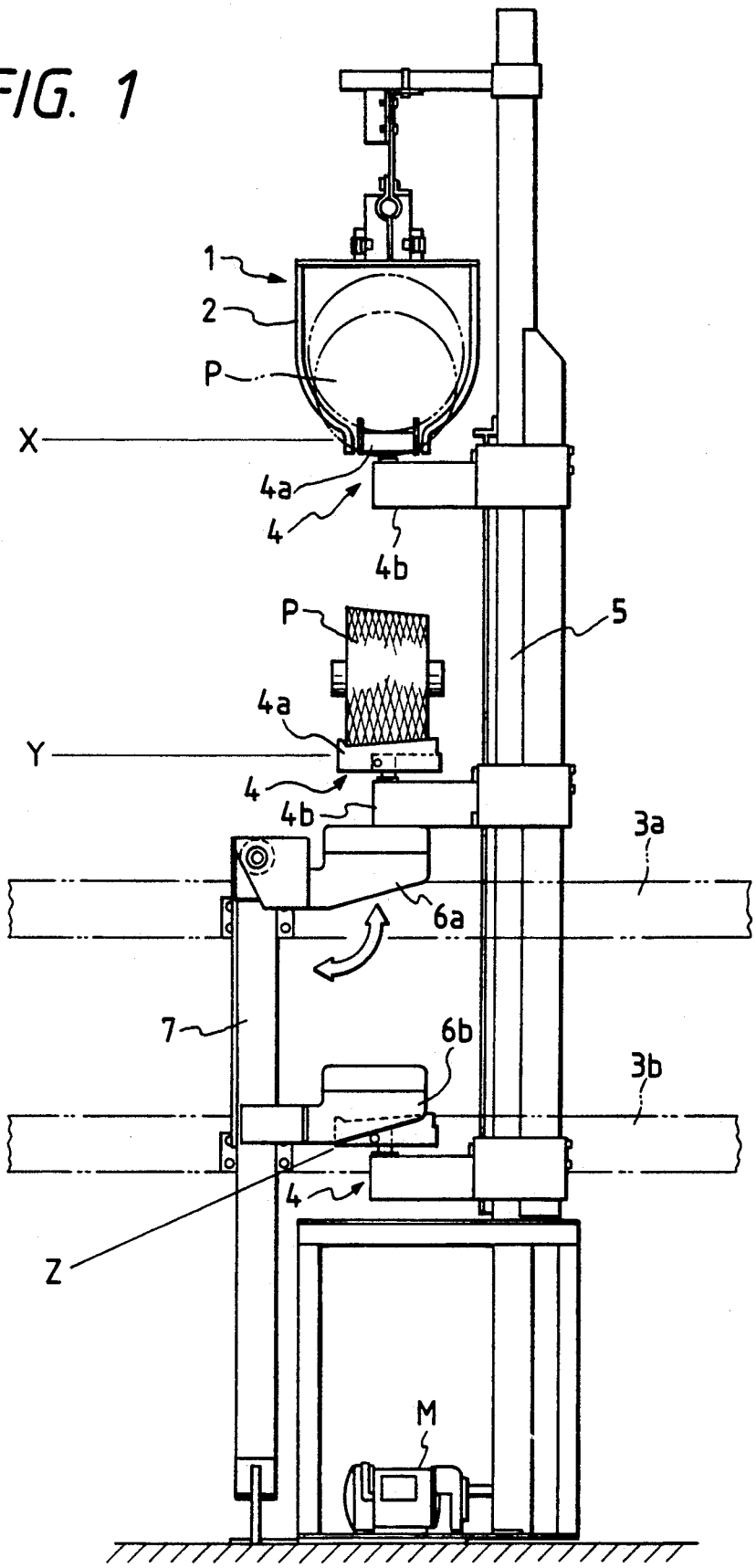
FIG. 1 is a schematic diagram of a package transfer equipment showing one example of the present invention.
Figure 5:
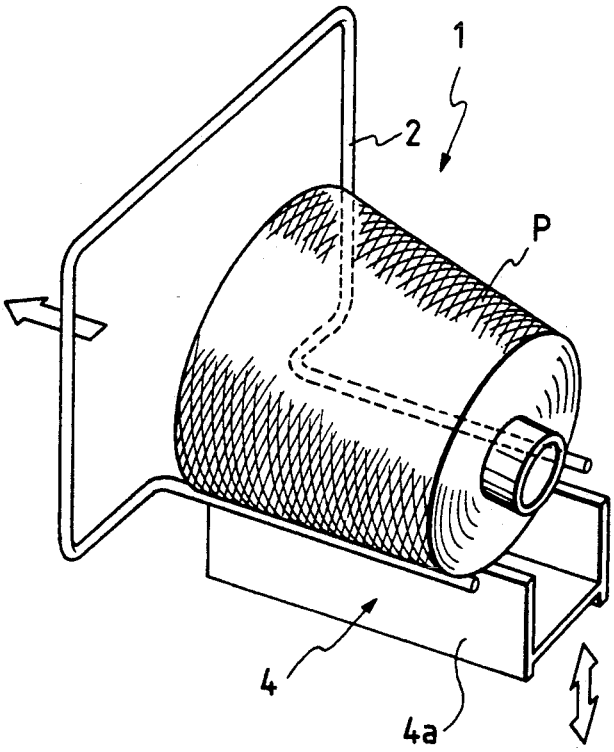
FIG. 5 is a perspective view of an overhead conveyor shown in FIG. 1.

A full package P from a winder, suspended in air from the overhead conveyor 1 as shown in FIG. 1, is transported along the conveyor track. This overhead conveyor 1, as shown in FIG. 5, is provided at a specific spacing with a plurality of rods 2 so bent as to support the package P from below, and is so designed as to transport these rods 2 in the direction of the arrow in the drawing. Beneath the overhead conveyor 1 are installed stock conveyors 3*a* and 3*b* in two stages, upper and lower, for stocking the packages P, intersecting at right angles with the direction of travel of the overhead conveyor 1.

Between the stock conveyors 3*a* and 3*b* and the overhead conveyor 1 is mounted a package elevator 4 for receiving the packages from the overhead conveyor 1 and transporting them downwardly. This package elevator 4, as shown in FIGS. 1 to 5, consists of a rest section 4*a* which is composed of two plates for supporting the package P from below, and a support section 4*b* rotatably supporting this rest section 4*a*. The support section 4*b* is engaged with a guide column erected on the floor, and is vertically moved by a motor M through a sprocket chain. The rest section 4*a* is designed to turn through 90 degrees on the way of vertical movement as indicated by X to Y in the drawing. This rotation of the rest section 4*a* is effected by operating a cam mechanism in the support section 4*b* by an air cylinder (not illustrated) mounted in the guide column 5.

Figure 2:
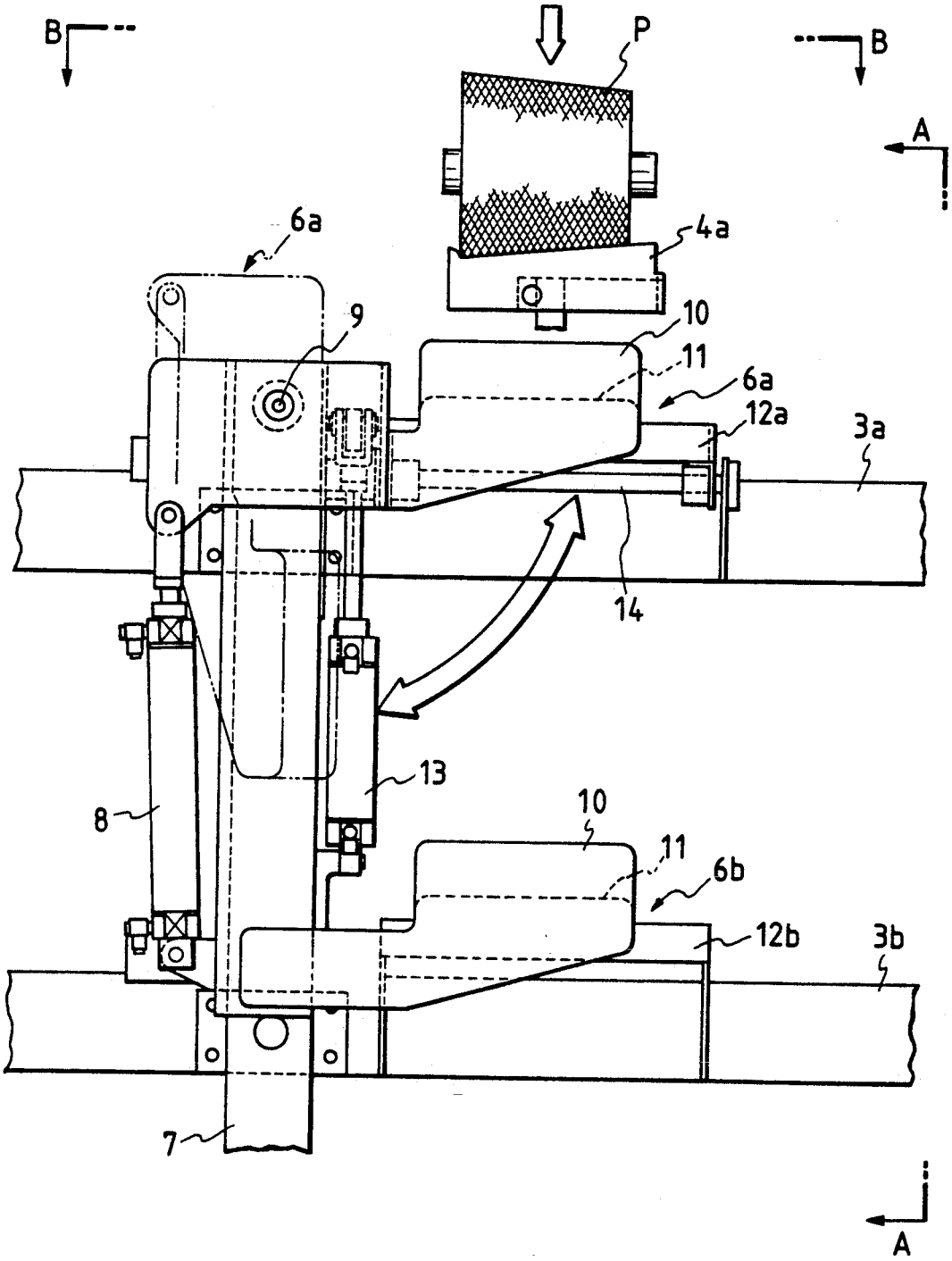
FIG. 2 is an enlarged view of a major portion of FIG. 1.

Below the runway of the package elevator 4 is mounted delivery plates 6*a* and 6*b* for delivering the packages P from the elevator rest section 4*a* to the stock conveyors 3*a* and 3*b* side. Of these delivery plates 6*a* and 6*b*, the upper delivery plate 6*a* is rotatably mounted on a column 7 erected on the floor as shown in FIG. 1. The delivery plate 6*a*, when in an up position (parallel with the floor surface), delivers the package P on the rest section 4*a* of the descending elevator to the stock conveyor 3*a* side, and at the same time, when in a down position (vertical in relation to the floor surface), allows the passage of the packages P on the elevator rest section 4*a*. Particularly the upper delivery plate 6*a*, as shown in FIG. 2, is rotatably supported at the central section by the column 7, and is turned through 90 degrees on the support point 9 by moving the end section of the upper delivery plate 6a upward by the air cylinder 8. That is, with the contraction of the air cylinder 8, the delivery plate 6a rotates upwardly to the runway of the elevator rest 4a, parallel with the floor surface as indicated by a full line in the drawing; also when the air cylinder 8 extends, the delivery plate 6a rotates downwardly away from the runway to a vertical position in relation to the floor surface as indicated by an alternate long and two short dashes line in the drawing. The air cylinder 8 is attached at one end to the end of the delivery plate 6a and at the other end to the column 7. Also, the lower delivery plate 6b is securely installed on the column 7, in a raised position (parallel with the floor surface).

Figure 3:
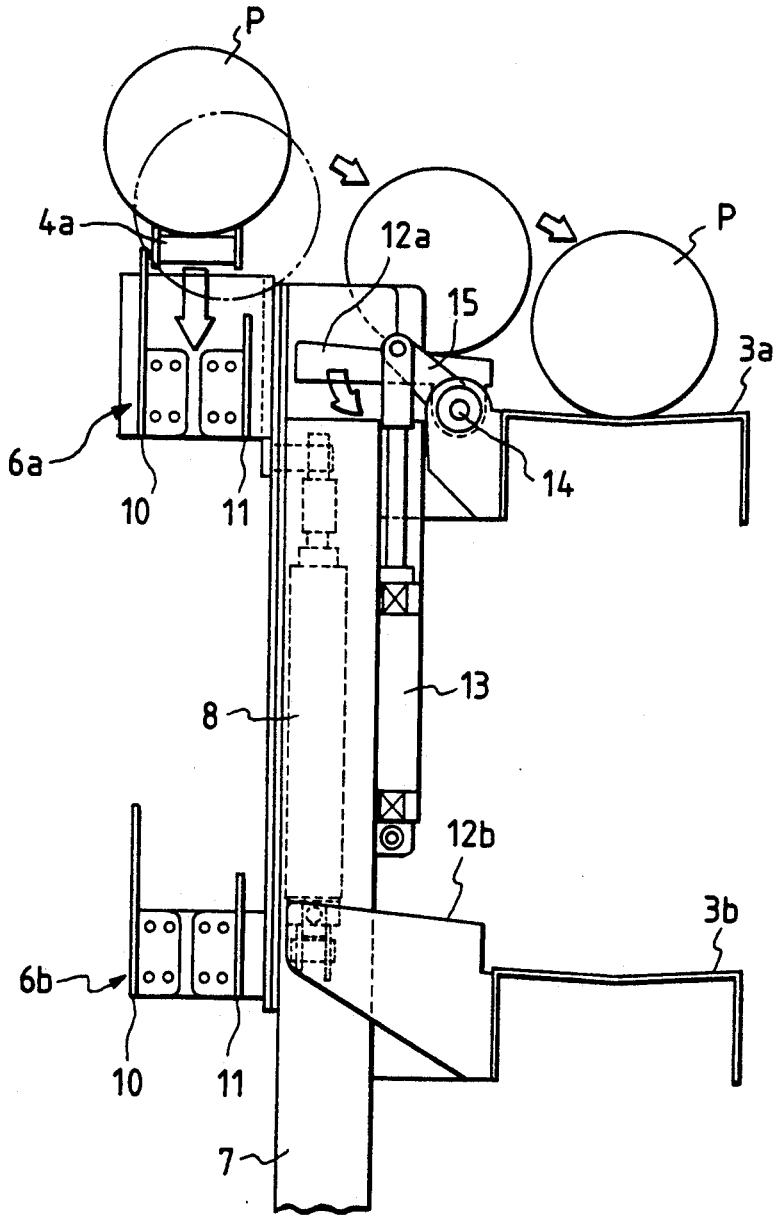
FIG. 3 is a view taken along line A—A of FIG. 2.
Figure 4:
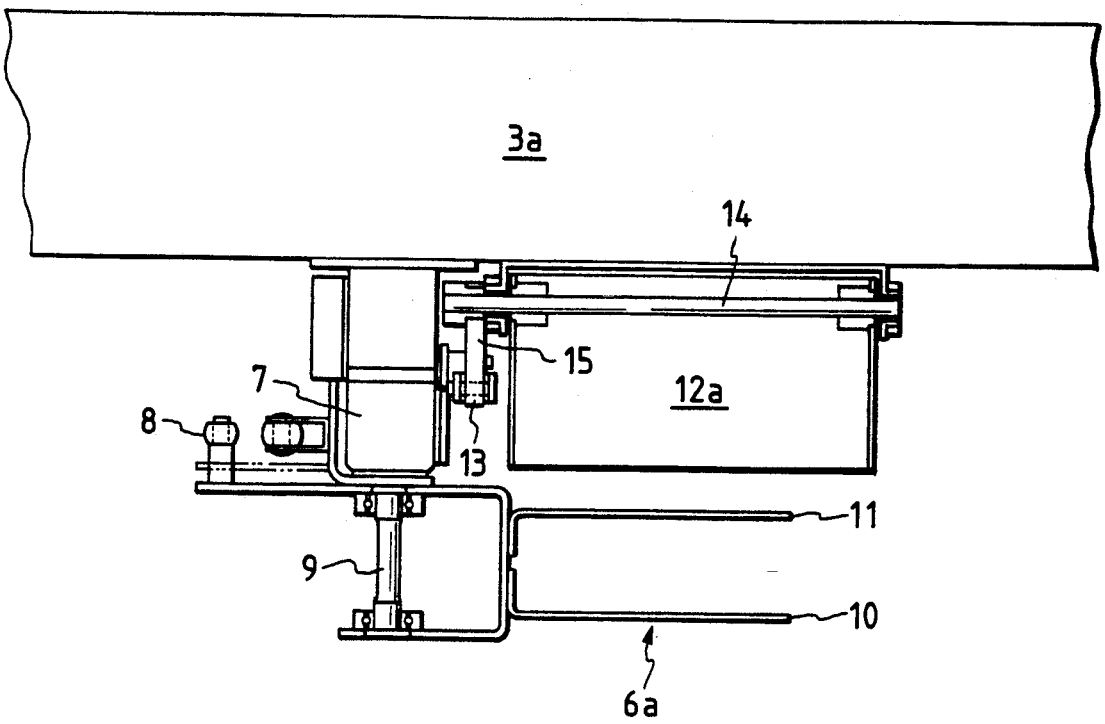
FIG. 4 is a view taken along line A-B of FIG. 2.

FIG. 3 is a view taken along line A—A of FIG. 2. The delivery plates 6a and 6b, as illustrated, is composed of two flat plates 10 and 11 arranged in parallel at a specific spacing. When the delivery plate 6a is in the up position, the elevator rest section 4a passes through between these flat plates 10 and 11. Of these flat plates 10 and 11, the flat plate 11 located near the stock conveyor 3a is formed lower than the flat plate 10 on the far side. When the elevator rest section 4a has passed through between the flat plates 10 and 11, the package P on the rest section 4a comes in contact with the flat plate 10, rolling rightward as indicated by the arrow in FIG. 3 to thereby transfer the package over to the upper stock conveyor 3a.

Between the delivery plates 6a and 6b and the stock conveyors 3a and 3b are provided receiving plates 12a and 12b which guide the rolling package P as shown in FIG. 3. Of these receiving plates 12a and 12b, the upper receiving plate 12a is designed to be rotated by an air cylinder 13. That is, the receiving plate 12a is rotatably supported at one end on the column 7; a rotating shaft 14 is provided with a bracket 15. When the end section of the bracket 15 is moved up and down by the air cylinder 13, the receiving plate 12a rotates on the rotating shaft 14 (see FIG. 4 which is a view taken along line B—B of FIG. 2). Concretely, with the extension of the air cylinder 13, the receiving plate 12a turns nearly in parallel (parallel rotation) with the floor surface as indicated by a full line in the drawing, on the center of the rotating shaft 14, and with the contraction of the air cylinder 13, the receiving plate 12a rotates downward (vertical rotation) until it is in its vertical position in relation to the floor surface as indicated by the arrow in FIG. 3. Here, the receiving plate 12a when in the up position, serves to guide the package P which rotates from the delivery plate 5a to the stock conveyer 3a. On the other hand, the receiving plate 12a, when in the down position, is withdrawn from the runway surface of the elevator rest section 4a; and therefore the downward passage of the packages on the elevator rest section 4a will not be disturbed. Also, the lower receiving plate 12b is fixedly installed on the column 7, approximately parallel with the floor surface at all times.

Next, the operation of the present example of the package transfer equipment of the above-described constitution will be explained.

As shown in FIGS. 1 to 5, the package P suspended from the overhead conveyor 1 is supported from below by means of the elevator rest section 4a when the package elevator 4 is raised, going away from the overhead conveyor 1. Then, after the passage of the overhead conveyor 1, the package elevator 4 is lowered to transport the package to the stock conveyors 3a and 3b side. In the process of this transport, the package P is turned through 90 degrees as indicated by X to Y in FIG. 1. The rotation of this package P is accomplished by turning the elevator rest section 4a through 90 degrees by operating the cam mechanism in the elevator support section 4b by the air cylinder (not illustrated) mounted in the guide column 5.

After this rotation, the package P is further moved downwardly. When the package P is stocked on the upper stock conveyor 3a, the upper delivery member 4a mounted on the runway of the elevator rest section 4a is turned to the up position parallel with the floor surface as shown in FIG. 2. At this time, the upper receiving plate 12a also is turned to a position nearly parallel with the floor surface. Then, as shown in FIG. 3, the package P on the elevator rest section 4a is held by the upper delivery member 6a, being guided by the upper receiving plate 12a and delivered to the upper stock conveyor 3a.

Furthermore, for stocking the package P to the lower stock conveyor 3b, the upper delivery member 6a is rotated to the vertical position relative to the floor surface as indicated by an alternate long and two short dashes line in FIG. 2, being withdrawn from the runway of the elevator rest section 4a. At the same time, the upper receiving plate 12a also is turned down to the vertical position relative to the floor surface. Then, the package P on the elevator rest section 4a which is descending, passes downwardly without being caught by the upper delivery member 6a and the upper receiving plate 12a, until the elevator rest section 4a moves downwardly as far as the Z position in FIG. 1. At this time, the package on the elevator rest section 4a is caught by the lower delivery member 6b, and is guided by the lower receiving plate 12b, being delivered to the lower stock conveyor 3b.

The package P can be stocked on a desired stock conveyor (3a or 3b) by moving the delivery members 6a and 6b and the receiving plates 12a and 12b up and down as described above. Furthermore, the above-mentioned package transfer equipment is of such an extremely simple constitution that the delivery members 6a and 6b are moved up and down in relation to the runway of the rest section 4a of the package elevator 4 for descending the packages P, and accordingly it is possible to accomplish the transfer of the packages P at a high speed and at a low cost.

The rest section 4a of the package elevator 4 is designed to turn through 90 degrees on the way of vertical movement as indicated by X to Y in the drawing. This rotation of the rest section 4a is effected by a link mechanism provided within the support section 4b and actuated by an air cylinder (described hereinafter) mounted in the guide column 5. The link mechanism will be illustrated.

Figure 6:
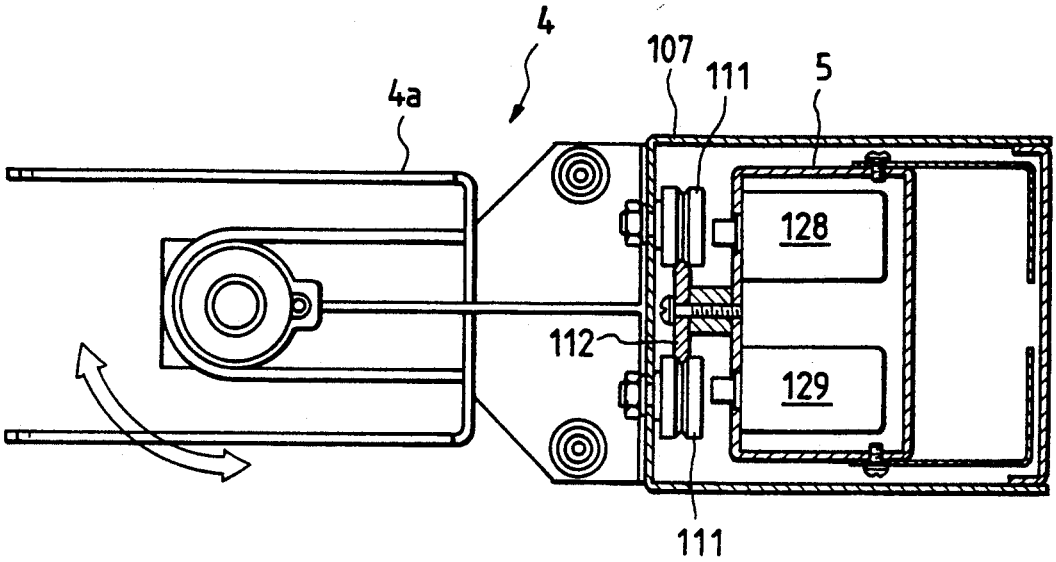
FIG. 6 is a plane view partly in section of the package elevator shown in FIG. 1.
Figure 7:
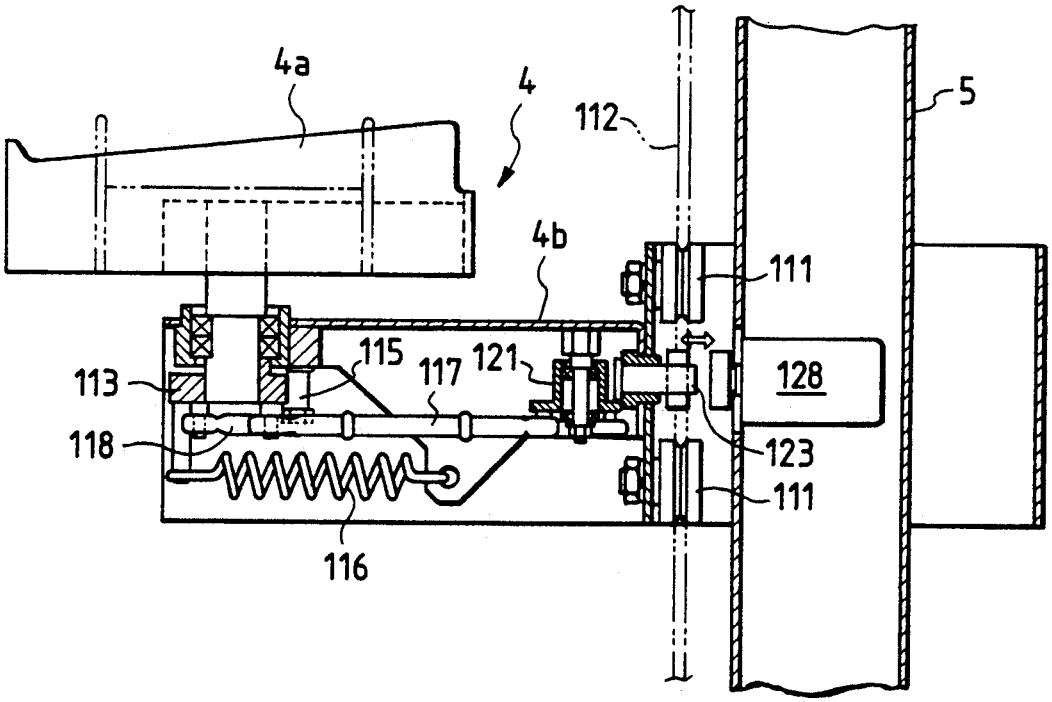
FIG. 7 is a vertical sectional view of the package elevator.

FIG. 6 is an upper face view of the package elevator and FIG. 7 is a side sectional view thereof. As shown in the drawings, the package elevator 4 comprises the support section 4b and the package rest section 4a which turns on the support section 4b. Two pair of four rollers 111 are provided within the support section 4b and the rollers 111 are located to put a guide rail 112 of the guide column 5 therebetween so that the support section 4b is lifted or lowered along the guide rail 112. On the other hand, the package rest section 4a may be turned about the support section 4b as shown in FIG. 6 by an arrow.

Figure 8A:
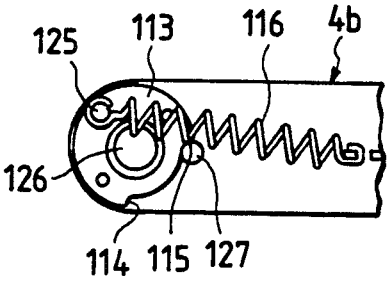
FIGS. 8*a* and 8*b* are schematic illustrations showing a turning mechanism of the package elevator.
Figure 8B:
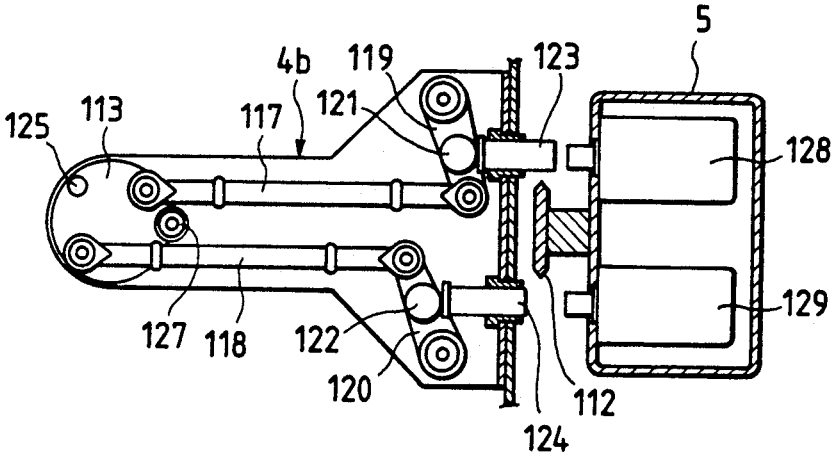

The turning mechanism is shown in FIG. 8. As shown in the drawing, a circular turn table 113 for supporting the package rest section 4*a* is provided within the support section 4*b*. The turn table 113 turns through 90 degrees between stoppers 114 and 115 about a center thereof. The turn table 113 is urged to turn-in a clockwise direction by means of a spring 116 and a first rod 117 and a second rod 118 are connected to the turn table 113. Another ends of the first rod 117 and the second rod 118 are connected with a first arm 119 and a second arm 120, respectively, which may swing about the other ends thereof to be a center of the swing motion. A first pin 121 and a second pin 122 are provided at the center portions of the first and second arms 119 and 120. These first and second pins 121 and 122 are pressed by a first push rod 123 and a second push rod 124.

According to the constitution of the turning mechanism mentioned above, when the first push rod 123 presses the first pin 121, the first arm 119 turns to move the first rod 117 in the leftward direction in the drawing, and the turn table 113 turns by 90 degrees in counterclockwise direction against the contracting force of the spring 116. Then, when a fixing pin 125 of the spring 116 mounted on the turn table 113 is moved lower than an extending line of a turning axis 126 of the turn table 113 and the stopper pin 127 in the drawing, the turn table 113 is automatically turned in the counterclockwise direction by the contracting force of the spring 116. On the other hand, the turn table 113 turns by 90 degrees in the clockwise direction to return in its original position when the second pin 122 is pushed by the second push rod 124.

Figure 9:
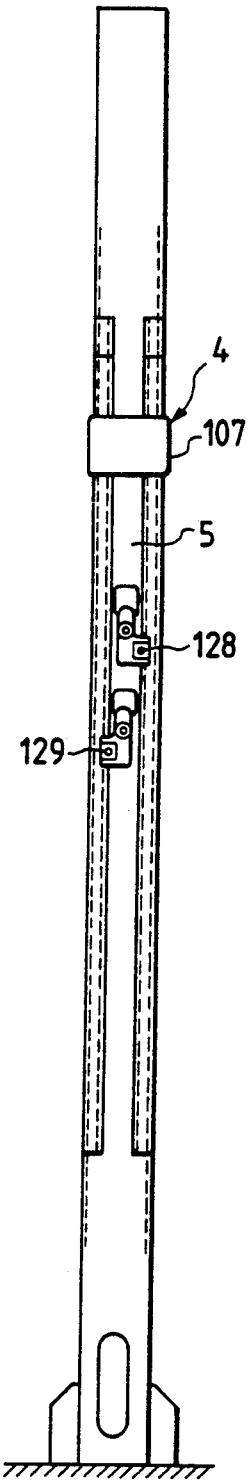
FIG. 9 is a side view of the guide column shown in FIG. 1.

The first and second push rods 123, 124 are operated to be pushed by a first and a second air cylinders 128, 129, respectively, provided within the guide column 5. As shown in FIG. 9, the first air cylinder 128 is located within the guide column 5 at the upper position than the position where the second cylinder is located. So, when the package elevator 4 is stopped at the corresponding position to the second cylinder 129 and the second push rod 124 is pressed by the second air cylinder 129, the package rest section 4*a* is turned reversely by 90 degrees from Y to X as shown in FIG. 1 to return to its original position.

According to the present invention, as explained above, the transfer of packages from the overhead conveyor to the stock conveyor can be effected at a high speed by use of the low-cost package transfer equipment of simplified constitution.

What is claimed is:

1. A package transfer system, comprising:

an overhead conveyor defining a travel direction, a first stock conveyor and a second stock conveyor, the first and second stock conveyors arranged at substantially right angles to the travel direction of the overhead conveyor, a package elevator located substantially between the overhead conveyor and the stock conveyors, the package elevator comprising a horizontally rotatable rest section for supporting a package and a vertically moveable support section for supporting the rest section, a first package delivery member associated with the first stock conveyor, a second package delivery member associated with the second stock conveyor, the first package delivery member being movable between an up position wherein the first package delivery member directs packages from the elevator to the first stock conveyor, and a down position wherein the packages on the elevator are deliverable to the second conveyor.

2. The system of claim 1, wherein the rest section is horizontally rotatable through an angle of approximately 90 degrees.

3. The system of claim 1, wherein the first package delivery member comprises a first flat plate and a second, substantially parallel flat plate, the first and second plates being mutually positioned to enable the rest section to pass therebetween when the first package delivery member is in the up position.

4. The system of claim 3, wherein the first plate is located closer to the first stock conveyor than the second plate and wherein the first plate is lower than the second plate, whereby a package on the rest section is transferred to the first stock conveyor when the rest section passes between the first and second plates.

5. The system of claim 4, further comprising a receiving plate provided between the delivery member and the stock conveyor for guiding a package.

* * * * *